US009427099B2

(12) United States Patent
Ming Ki Gordon et al.

(10) Patent No.: US 9,427,099 B2
(45) Date of Patent: Aug. 30, 2016

(54) NON-CONTACT LIQUID SENSING DEVICE

(75) Inventors: Au Ming Ki Gordon, Hong Kong (CN); Ng Kwok Leung, Hong Kong (CN); Tang Tat Man, Hong Kong (CN); Benjamin Poate, London (GB); Warren Kronberger, Lombard, IL (US)

(73) Assignee: THE MARKETING STORE WORLDWIDE, LP, Chicago, IL (US)

( * ) Notice: Subject to any disclaimer, the term of this patent is extended or adjusted under 35 U.S.C. 154(b) by 410 days.

(21) Appl. No.: 13/236,086

(22) Filed: Sep. 19, 2011

(65) Prior Publication Data

US 2012/0074154 A1 Mar. 29, 2012

Related U.S. Application Data

(60) Provisional application No. 61/386,273, filed on Sep. 24, 2010.

(51) Int. Cl.
*G01R 27/26* (2006.01)
*A47G 21/18* (2006.01)

(52) U.S. Cl.
CPC ..... *A47G 21/182* (2013.01)

(58) Field of Classification Search
CPC .. G01N 33/14; G01G 19/4146; G01V 3/104; G01R 29/0892
USPC ..... 324/66–67, 258, 260, 200, 239, 228, 324/329; 340/551, 568.1, 572.7, 686.6
See application file for complete search history.

(56) References Cited

U.S. PATENT DOCUMENTS

| | | | | |
|---|---|---|---|---|
| 7,025,653 | B1 * | 4/2006 | Hawkins | B65D 81/366 206/457 |
| 2006/0032897 | A1 | 2/2006 | Cho | |
| 2006/0087831 | A1 * | 4/2006 | Kramer | 362/101 |
| 2007/0222619 | A1 | 9/2007 | Moran | |
| 2009/0031798 | A1 | 2/2009 | Radhakrishnan et al. | |
| 2009/0090178 | A1 * | 4/2009 | Sasanuma et al. | 73/295 |
| 2009/0158841 | A1 * | 6/2009 | Winkens | 73/304 C |
| 2009/0314798 | A1 * | 12/2009 | Hovinen et al. | 222/23 |
| 2011/0292299 | A1 * | 12/2011 | Lau et al. | 348/734 |

* cited by examiner

*Primary Examiner* — Melissa Koval
*Assistant Examiner* — Trung Nguyen
(74) *Attorney, Agent, or Firm* — Mark T. Vogelbacker; Reed Smith LLP

(57) ABSTRACT

Consumer devices for providing feedback based upon the presence of a liquid in a detection zone, wherein the detection zone is the area in which a change in capacitance is can be detected by a non-contact capacitance sensor and the forms of feedback include the generation of sound, activation/deactivation of alight, a motion or other physical interaction, or display by way of an LCD or LED display panel.

16 Claims, 5 Drawing Sheets

BEACH BALL

NON-CONTACT LIQUID SENSING DEVICE

CROSS-REFERENCE TO RELATED APPLICATION

This application claims the benefit of U.S. Provisional Patent Application No. 61/386,273 filed Sep. 24, 2010, the disclosure of which is incorporated herein by reference for all purposes.

BACKGROUND

In the field of liquid sensing device design and consumer devices, there are known a vast array of devices that generate sounds, physical actions, mode switching or other feedback based upon user interaction, internal/external timers and other commonly used means for stimulus. A subset of these devices provide feedback based upon liquid sensing. That is, for example, a children's toy straw that detects the flow or presence of a liquid through the straw tube and then provides a specific feedback based upon said detection. By way of further example, there are in the prior art children's toys that provide feedback based upon whether or not a reservoir or mold is filled with a sufficient amount of water or other liquid. The use of liquids, i.e., the presence, rate of flow, or amount of, has commonly been used as a stimulus for the generation of feedback (i.e. sound generation, performance of actuators, gyration, etc.) in consumer devices such as toys and novelty devices.

DETAILED DESCRIPTION

There is a need in the art for an efficient and safe means for sensing the presence of, amount of, or flow rate of liquids in consumer items. For example, it is known in the prior art that the presence of liquid in the environment of a consumer devices, such as toys, may be sensed via conductive contacts that protrude from an electronic module through the walls of a toy into the liquid-exposed environment. This implementation is problematic for several reasons. First, it is to be appreciated by those skilled in the art that exposed conductive contacts or wiring of any kind is undesirable in consumer devices due to child or other safety concerns. Second, it is to be appreciated by those skilled in the art that exposed conductive contacts or wiring of any kind is not aesthetically pleasing to the user. Third, it is to be appreciated by those skilled in the art that such implementations can induce liquid leakage through the walls of the consumer device to an electronic module and thereby cause damage to the functionality of the device, generally, and/or the electronic sensor, specifically. Fourth, it is to be appreciated by those skilled in the art that there exist manufacturing efficiency, cost and quality control issues related to providing safe and economically viable consumer devices that are capable of providing feedback based upon the sensing of a liquid.

Accordingly, there is a need in the art for efficient to manufacture and safe to use consumer devices that provide feedback based upon the sensing of a liquid. Various embodiments of the present invention will be described in detail with reference to the drawings. Reference to various embodiments does not limit the scope of the invention, which is limited only by scope of claims attached hereto. Additionally, any examples set forth in this specification are not intended to be limiting and merely set forth some of the many possible embodiments. Also, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items.

Figure 1:
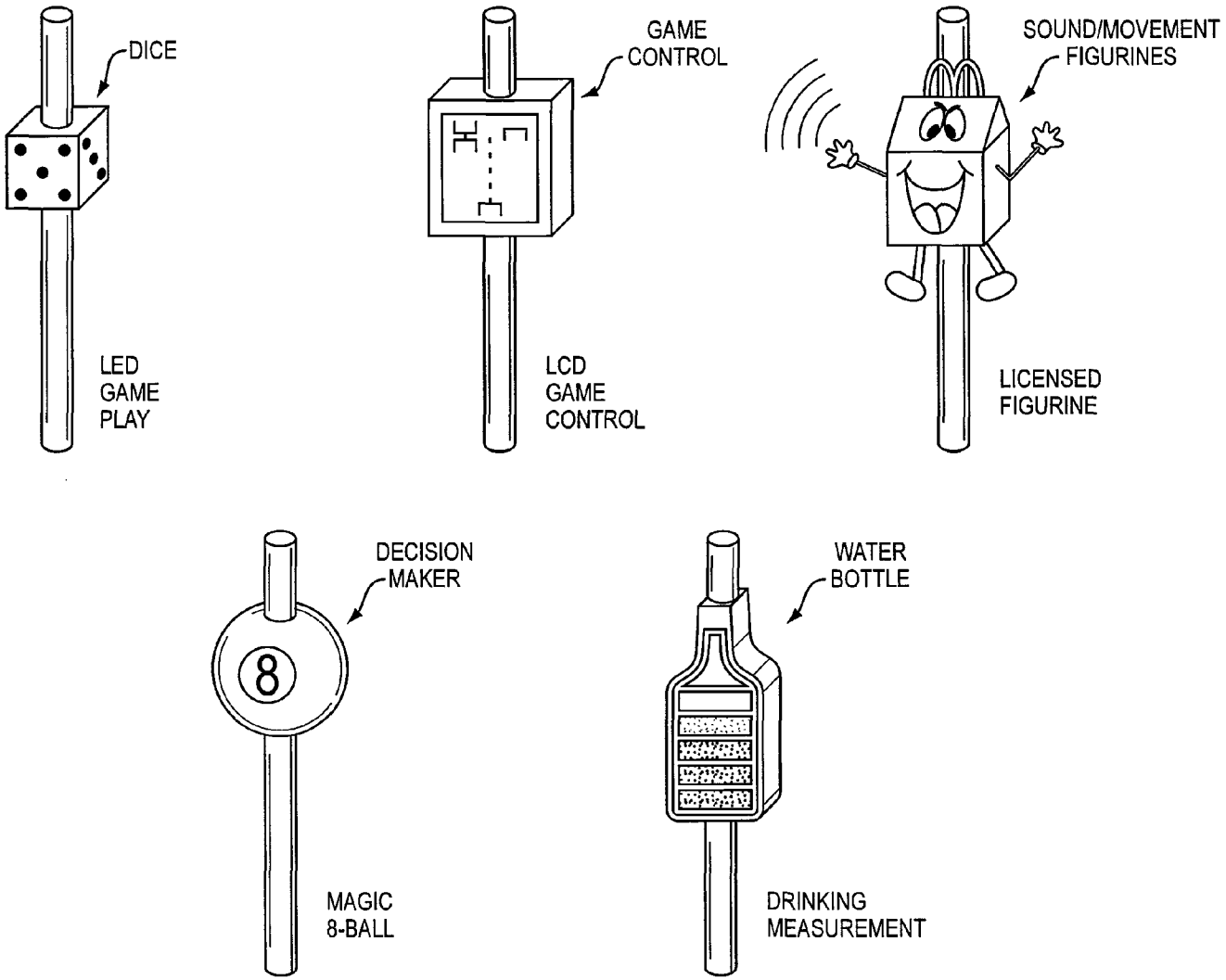
FIG. 1 is a drawing of exemplary embodiments.

The disclosed embodiments include apparatuses for sensing liquid comprising the generation of a feedback based on whether a liquid is or is not sensed by one or more non-contact capacitance sensors configured to operate with (or as an integrated part of) an electronic module. Referring to FIG. 1, in an embodiment, a molded figurine, shape, or object is provided that forms an enclosure around a conventional drinking straw. The drinking straw may be ornate in design or plain as is often made available in commercial restaurants, or be made of plastic or paper materials or any other material. The drinking straw may further comprise additional shapes or "loops". In this embodiment, the molded figurine comprises an electronic module configured to operate with or has otherwise co-located or integrated within a PCB a non-contact capacitance sensor. As is known to those skilled in the art of capacitance sensors, non-contact capacitive sensors work by measuring changes in capacitance. That is, when the non-contact capacitance sensor is in proximity to an object having an electric charge, the sensor detects the amount of electric charge, i.e., a change in the capacitance of the object in which the sensor is in proximity to may be detected. The molded figurine houses the electronic module (including the non-contact capacitance sensor). The molded figurine may further comprise hinges such that it may be opened and closed around the drinking straw and cause the position of the non-contact capacitance sensor to be in proximity to (or touching) the drinking straw consistent with the sensing range of the sensor. Alternatively, the molded figurine may be manually mounted to the drinking straw by drawing the straw through the enclosure of the molded figurine, thereby positioning the non-contact capacitance sensor in proximity to the area of the drinking straw through which a liquid may flow. Upon joining the molded figurine with the drinking straw, a detection region is formed. That is, the detection region is the portion of the drinking straw enclosed within the molded figurine for which changes in capacitance can be detected by the sensor. The straw may be removed for cleaning, or replaced with another straw, which is desirable. In this embodiment, use of the straw will result in a change of capacitance to be detected by the sensor as a liquid passes through (or remains in) the detection zone. This change in capacitance may cause the electronic module to provide a feedback, wherein the feedback may be the generation of a sound, activation/deactivation of a light, a motion or other physical interaction of the molded figurine, appendage, shape or object forming the enclosure, or part thereof, or the display by way of a LCD or LED display panel, or any other feedback that is known in the art. It is to be appreciated by those skilled in the art that the change in capacitance may similarly cease the playback of a feedback upon a capacitance change. By way of non-limiting example, the molded figurine housing the non-contact capacitance sensor and electronic module may provide certain feedback; for example, a die having LEDs being randomly activated during the period of capacitance change when the liquid passes through the detection zone, the display of a game or graphic on an LCD display dependent upon the detected capacitance, a sound module playing a sound related to the theme of the molded figurine, a "magic 8-ball" or randomizer which plays a sound, provides/activates a graphic, or causes a motion depending upon the randomly generated outcome, or causing a change in a meter indicating the amount of liquid that has been consumed, or passed through the detection region, or period of time of capacitance change. The advantage of the foregoing embodiments over the prior art is clear, as they do not require a specially designed drinking straw, any protruding conductive materials in the drinking stream, and provide significant advantages in portability and reusability. In a further alternative embodiment, the enclosure may be fixed to a drinking straw thereby forming a single consumer device.

Figure 2:
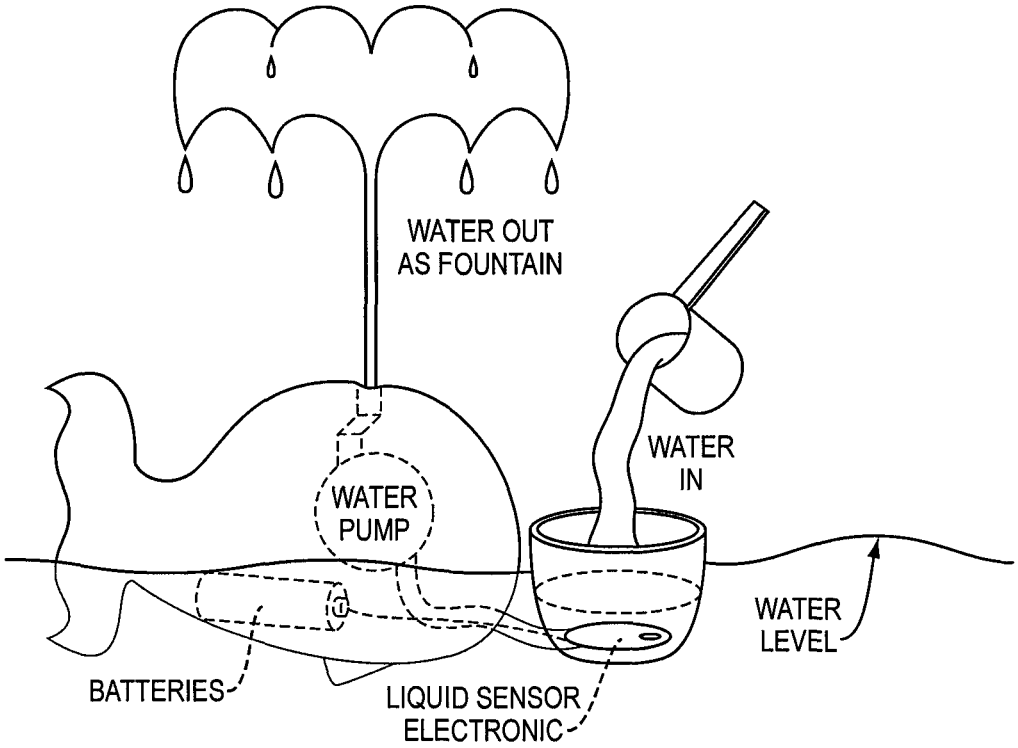
FIG. 2 is a drawing of exemplary embodiments.
Figure 2:
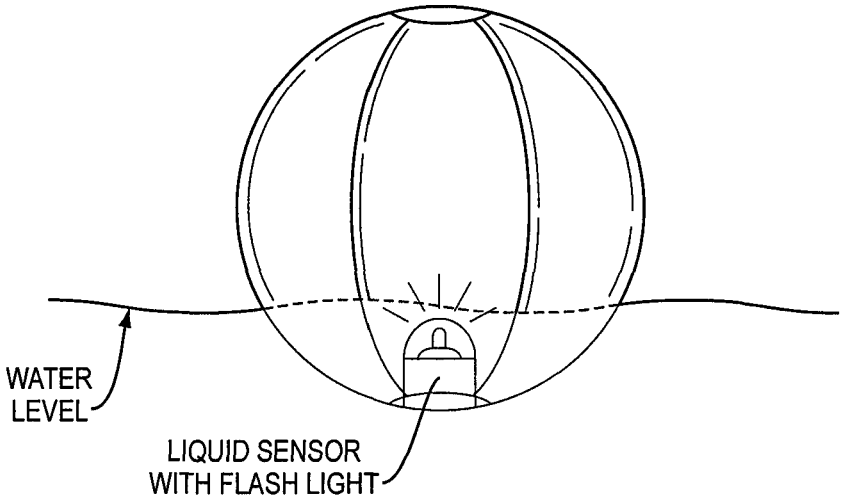

In a further embodiment, referring to FIG. 2, a consumer device comprising an electronic module and non-contact capacitance sensor may be a toy or other device that is desirable to use in a bath, at the beach or in a pool, i.e., a toy having a vessel for holding liquid or is partially or fully submersible. In this embodiment, a feedback (as discussed above) may be provided when the detection zone is immersed in water, or, alternatively, when a vessel aspect of the toy is filled with a liquid. This embodiment provides significant advantages over the prior art. For example, the conductive contacts in the prior art for submersible toys providing feedback require greater expense and quality control to ensure that the toy is properly sealed. The present embodiment does not require exposed conductive contacts and does away with similar functionality risks associated with an electronic module being exposed to liquids.

Figure 3:
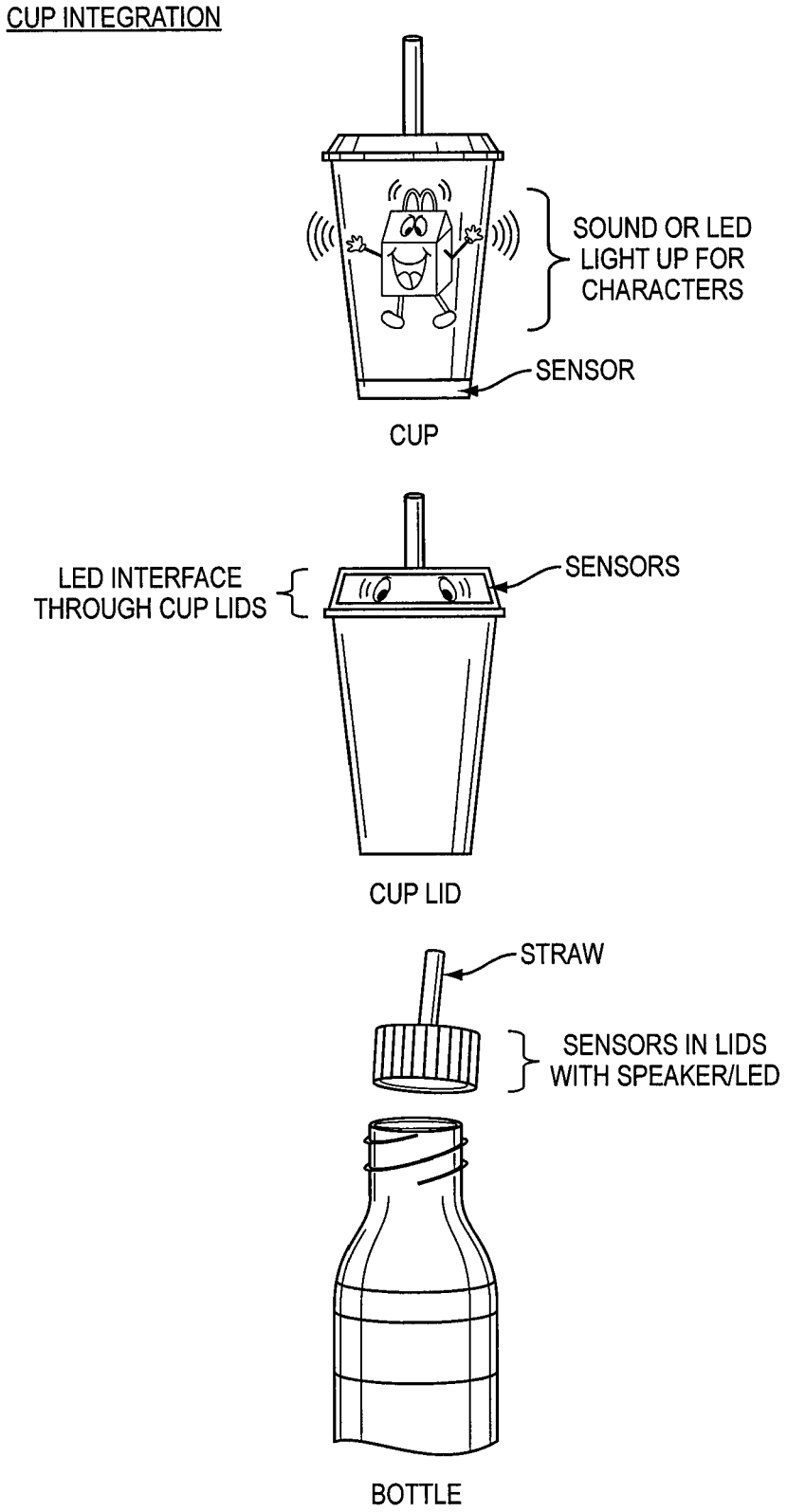
FIG. 3 is a drawing of exemplary embodiments.
Figure 4:
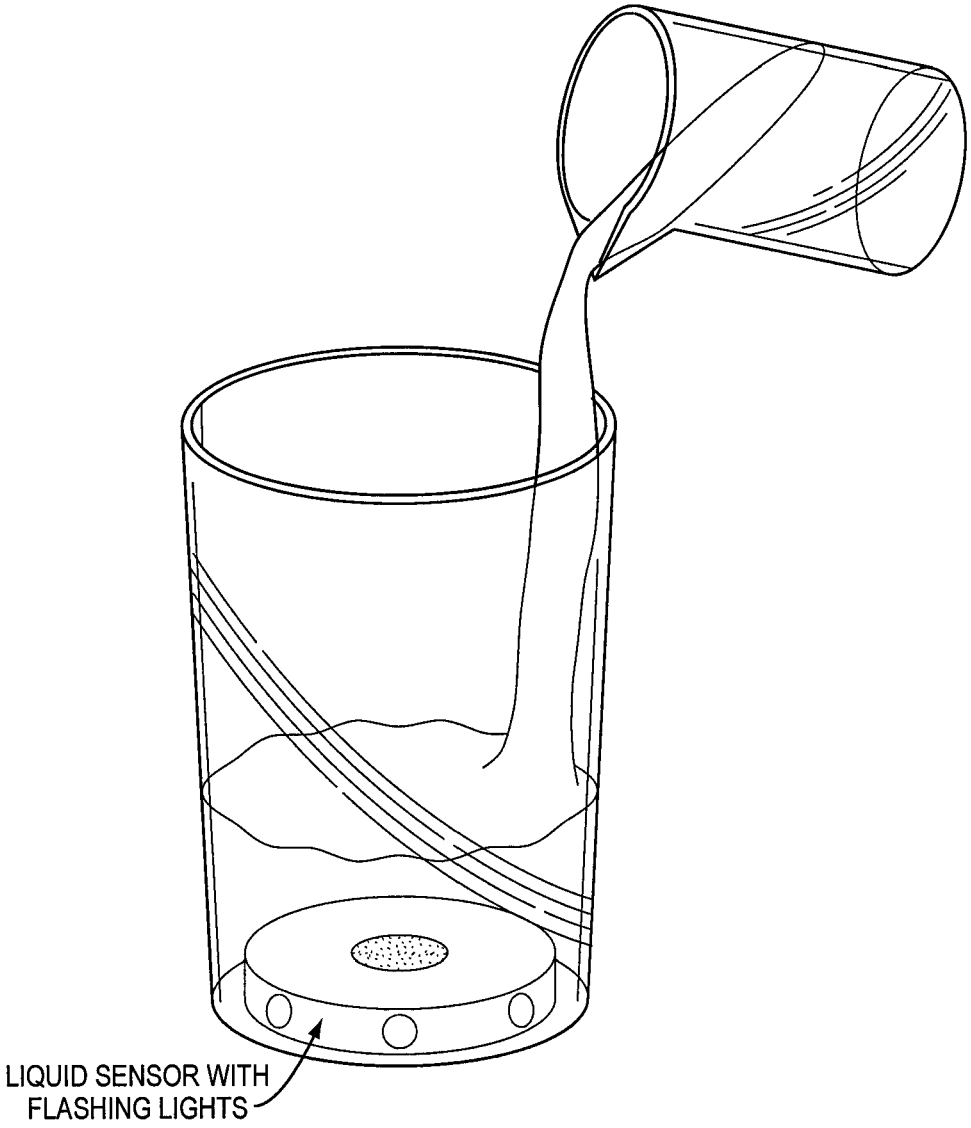
FIG. 4 is a drawing of exemplary embodiments.

In another embodiment, referring to FIG. 3, a beverage container (e.g., glass or plastic drinking cup or other container known in the art) may have integrated therein an electronic module comprising a non-contact capacitance sensor and means for feedback. In this embodiment, the detection zone of the sensor may be positioned in proximity to the floor of the drinking cup, the upper portion of the cup or the lid of a cup. A change in capacitance may be sensed when the cup is empty/full or substantially empty/full of liquid, is tipped to a drinking position, or upon removal of the lid. The lid may be a resealable lid having any shape, or a removable screw-top lid. These capacitance change scenarios may cause the electronic module to provide a feedback, as discussed above. Alternatively, referring to FIG. 4, an electronic module comprising a non-contact capacitance sensor may be integrated into a cup coaster, as is commonly understood in the art. There may be a change in capacitance detected (which triggers a feedback) when a cup or liquid is placed on the cup coaster.

Figure 5:
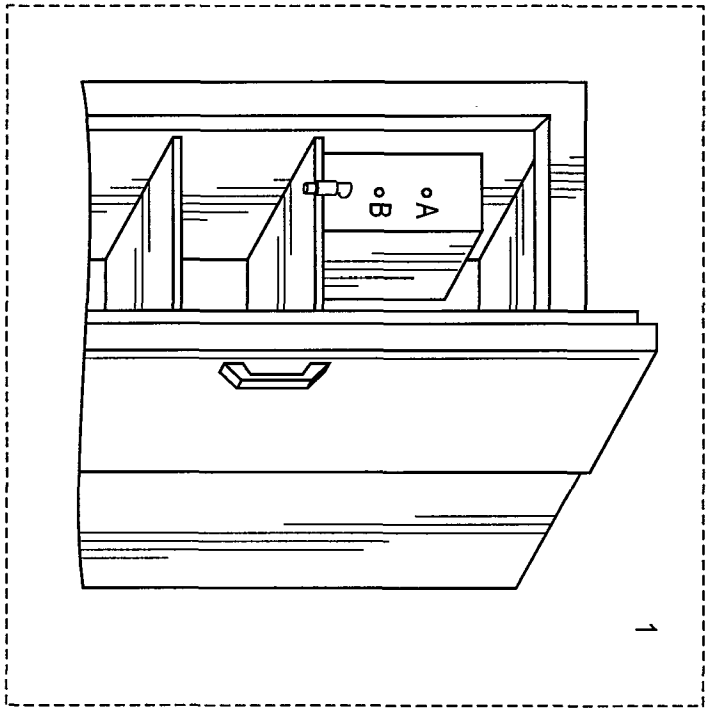
FIG. 5 is a drawing of exemplary embodiments.
Figure 5:
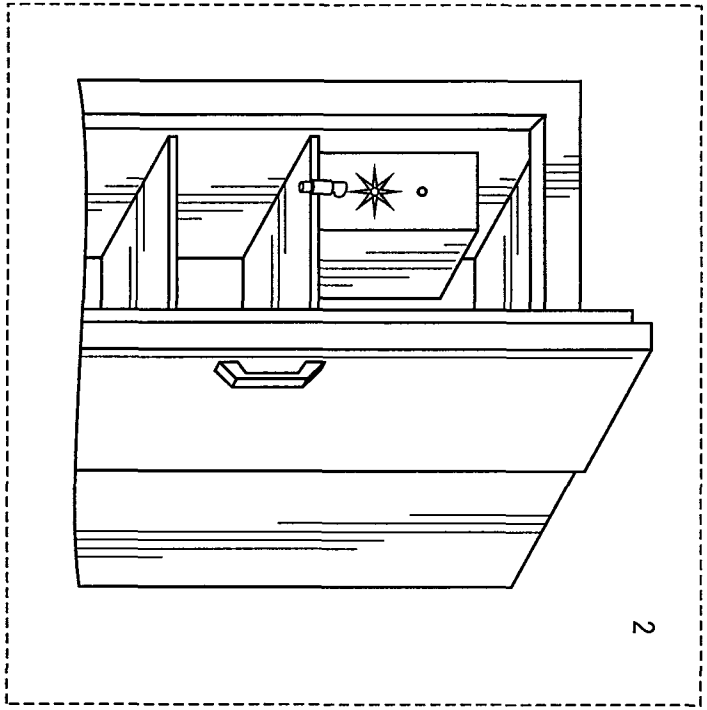

In yet another embodiment, referring to FIG. 5, an electronic module comprising a non-contact capacitance sensor may be integrated into a commercially available boxed beverage, e.g., "boxed wine." The sensor may be placed at a user-defined position on the box so as to demarcate a consumption alert level or at a previously determined position and, upon detection of a capacitance change at that position, the electronic module may provide an alert or other feedback indicating that the remaining contents may soon be consumed or otherwise depleted. Alternatively, the electronic module comprising the sensor may provide a liquid quantity status via an electronic display upon an action by a user, e.g., an indication of the refrigerator door being opened as provided by photocells/diodes integrated with the electronic module, or by the user pressing a button to check the content level of the box. This embodiment provides certain advantages over the prior art; for example, in the prior art it would be required that a user remove the liquid-containing box from a refrigerator (or shelf or other storage location) and tilt it to assess the quantity remaining. The disclosed embodiment solves this problem by providing a specific indication (feedback) as to whether the fluid content in the box is either greater than or less than a predetermined level as defined by the location/placement of the sensor on the container package. By way of non-limiting example, feedback in this embodiment may further include a green/red light, LCD icon or sound indicating that there is or is not liquid at the predetermined level. In an alternative embodiment, the electronic module and capacitance sensor is activated upon user-initiated use of the box's dispensing mechanism, e.g., valve.

What is claimed is:

1. A drinking container for providing feedback based upon the presence of a liquid in a detection zone, the drinking container comprising:

a beverage portion in the form of a cup or bottle, the beverage portion including a bottom wall and a sidewall extending upwardly therefrom, the beverage portion being configured to hold the liquid; and a figurine configured to receive a drinking straw, the figurine forming an enclosure extending around the drinking straw, the figurine being movable with respect to the beverage portion, the figurine housing:

a non-contact capacitance sensor; and an electronic module, wherein the electronic module is configured to i) receive a change in capacitance from the sensor as the liquid passes through or remains in the drinking straw and ii) to cause feedback.

2. The drinking container of claim 1, further comprising the drinking straw.

3. The drinking container of claim 2, wherein the drinking straw is fixed to the figurine.

4. The drinking container of claim 2, wherein the detection zone is defined by where the enclosure extends around the drinking straw.

5. The drinking straw of claim 4, wherein the feedback is one of a generation of a sound, activation of a light, and movement of at least a portion of the figurine.

6. The drinking straw of claim 4, wherein the change in capacitance causes the feedback.

7. The drinking container of claim 1, wherein the figurine includes one or more hinges.

8. The drinking container of claim 7, wherein the figurine is configured to be opened and closed around the drinking straw.

9. The drinking container of claim 8, wherein the figurine is configured to cause a position of the non-contact capacitance sensor to be in proximity to the drinking straw.

10. The drinking container of claim 8, wherein the figurine is configured to cause a position of the non-contact capacitance sensor to touch the drinking straw.

11. The drinking container of claim 1, wherein the non-contact capacitance sensor is located within a printed circuit board.

12. The drinking container of claim 1, wherein the figurine is configured to be mounted to the drinking straw by moving the drinking straw through the enclosure of the figurine.

13. The drinking container of claim 1, wherein the figurine is molded.

14. The drinking container of claim 1, wherein the figurine is in the shape of one of a cue ball, a die, a game controller, and a bottle.

15. A drinking container for providing feedback based upon the presence of a liquid in a detection zone, the drinking container comprising:

a beverage portion in the form of a cup or bottle, the beverage portion including a bottom wall and a sidewall extending upwardly therefrom, the beverage portion being configured to hold the liquid;

a drinking straw; and a figurine configured to receive at least a portion of the drinking straw, the figurine including at least one hinge and forming an enclosure extending around the drinking straw, the at least one hinge allowing the figurine to open and close around the drinking straw, the figurine being movable with respect to the beverage portion, the detection zone being defined by where the enclosure extends around the drinking straw, the figurine housing:

a printed circuit board including a non-contact capacitance sensor configured to detect an electric charge; and an electronic module configured to receive a change in capacitance from the non-contact capacitance sensor as the liquid passes through or remains in the drinking straw to cause feedback.

16. A drinking container for providing feedback based upon the presence of a liquid in a detection zone, the drinking container comprising:

a drinking straw configured to be inserted into a beverage portion in the form of a cup or a bottle, the beverage portion including a bottom wall and a sidewall extending upwardly therefrom, the beverage portion being configured to hold the liquid; and a figurine configured to receive at least a portion of the drinking straw, the figurine forming an enclosure extending around the drinking straw, the figurine being configured to be mounted to the drinking straw by moving the drinking straw through the enclosure of the figurine, the figurine being movable with respect to the beverage portion, the detection zone being defined by where the enclosure extends around the drinking straw, the figurine housing:

a printed circuit board including a non-contact capacitance sensor configured to detect an electric charge; and an electronic module configured to receive a change in capacitance from the non-contact capacitance sensor as the liquid passes through or remains in the drinking straw to cause feedback.

* * * * *